United States Patent [19]

Marks et al.

[11] 4,235,502

[45] Nov. 25, 1980

[54] MOUNTING MEANS FOR MOUNTING A CONNECTOR IN A PANEL

[75] Inventors: Richard L. Marks, Mechanicsburg; Charles H. Weidler, Lancaster, both of Pa.

[73] Assignee: AMP Incorporated, Harrisburg, Pa.

[21] Appl. No.: 32,047

[22] Filed: Apr. 23, 1979

Related U.S. Application Data

[63] Continuation-in-part of Ser. No. 879,575, Feb. 21, 1978, Pat. No. 4,168,874.

[51] Int. Cl.[3] ..... H01R 13/506

[52] U.S. Cl. ..... 339/278 R; 339/128; 248/225.3 R; 174/48; 248/27.3; 248/DIG. 6

[58] Field of Search ..... 339/125 R, 126 R, 126 RS, 339/128, 278 R; 403/405, 409

[56] References Cited

U.S. PATENT DOCUMENTS

| | | | |
|---|---|---|---|
| 3,091,679 | 5/1963 | Norden | 200/168 |
| 3,289,145 | 11/1966 | Ruehlemann et al. | 339/128 |
| 3,337,836 | 8/1967 | Churla, Jr. | 339/49 |
| 3,432,802 | 3/1969 | Ritchie | 339/128 |
| 3,719,917 | 3/1973 | Fischer et al. | 339/128 |
| 3,828,302 | 8/1974 | Cieniawa et al. | 339/91 R |
| 3,874,762 | 4/1975 | Shott et al. | 339/91 R |
| 3,903,458 | 9/1975 | Arnoux | 339/128 |
| 3,963,319 | 6/1976 | Schumacher et al. | 339/176 MF |
| 4,025,142 | 5/1977 | Huber et al. | 339/128 |

FOREIGN PATENT DOCUMENTS

| | | | |
|---|---|---|---|
| 2638604 | 2/1978 | Fed. Rep. of Germany | 339/125 R |
| 2000387 | 1/1979 | United Kingdom | 339/128 |

*Primary Examiner*—John McQuade

*Attorney, Agent, or Firm*—Frederick W. Raring

[57] ABSTRACT

A molded latching device is disclosed which, along with a similar latching device, is intended for assembly to a rearward corner of a connector housing thereby to provide latching means on the housing for latching the housing to an opening in a panel. The latching device comprises an L-shaped member having first and second arms. The arms have first and second internal surfaces which define a pocket dimensioned to receive a rearward corner of the connector housing. Attaching means are provided on the first arm for attaching the latching device to the housing and a flexible latch arm extends parallel to the second arm for engagement with the surface of the panel. The second arm has bearing surfaces at its free end for engagement with surface portions of the panel.

7 Claims, 4 Drawing Figures

MOUNTING MEANS FOR MOUNTING A CONNECTOR IN A PANEL

FIELD OF THE INVENTION

This invention relates to latching devices intended for assembly to an electrical connector housing for latching the housing to an opening in a panel. This application is a continuation-in-part of application Ser. No. 879,575 filed Feb. 21, 1978, now U.S. Pat. No. 4,168,874.

BACKGROUND OF THE INVENTION

It is common design practice in the electrical connector field to provide latching means on connector housing to permit the housings to be mounted in an opening in a panel. Previously, the latching means were molded integrally with the housing and it was necessary to provide latching means on every housing part which might, in use, be mounted in a panel. U.S. Pat. No. 4,168,874 discloses and claims separate latching devices which can be assembled to a connector housing when required to mount the housing in a panel and which need not be assembled to the housing if they are not required. In accordance with one embodiment of the latching devices disclosed in that patent, two separate latching means are provided on the housing at the rearward corners thereof, the two latching devices being non-symmetrical and dissimilar so that two different molded parts are required to provide a complete latching means on a housing. The present invention is directed to the achievement of an improved latching device which can be assembled to either corner of a connector housing so that only one type of latching means is required. Latching devices in accordance with the invention can be assembled to either of the two mating housings of a connector pair, as required, to mount either of the two housings of the assembly in a panel.

A preferred embodiment of the invention comprises an L-shaped member of molded thermoplastic material having first and second arms. The arms have first and second internal surfaces which intersect to define a pocket which is dimensioned to receive one corner of the connector housing. The first arm has attaching means thereon for attaching the latching device to the housing and the second arm has at its free end, bearing surfaces which bear against the panel in which the connector is mounted to stabilize the connector in the panel opening. A flexible latch arm extends parallel to the second arm and has rearwardly facing shoulder means on its end for engagement with the panel. When a connector is to be mounted on a panel, it is merely necessary to assemble two latching devices to the rearward corners of the housing, insert the housing through the panel opening until the bearing surfaces of the latching members are against the panel on one side thereof and the latch arms engage the other side.

PRACTICE OF THE INVENTION

Figure 1:
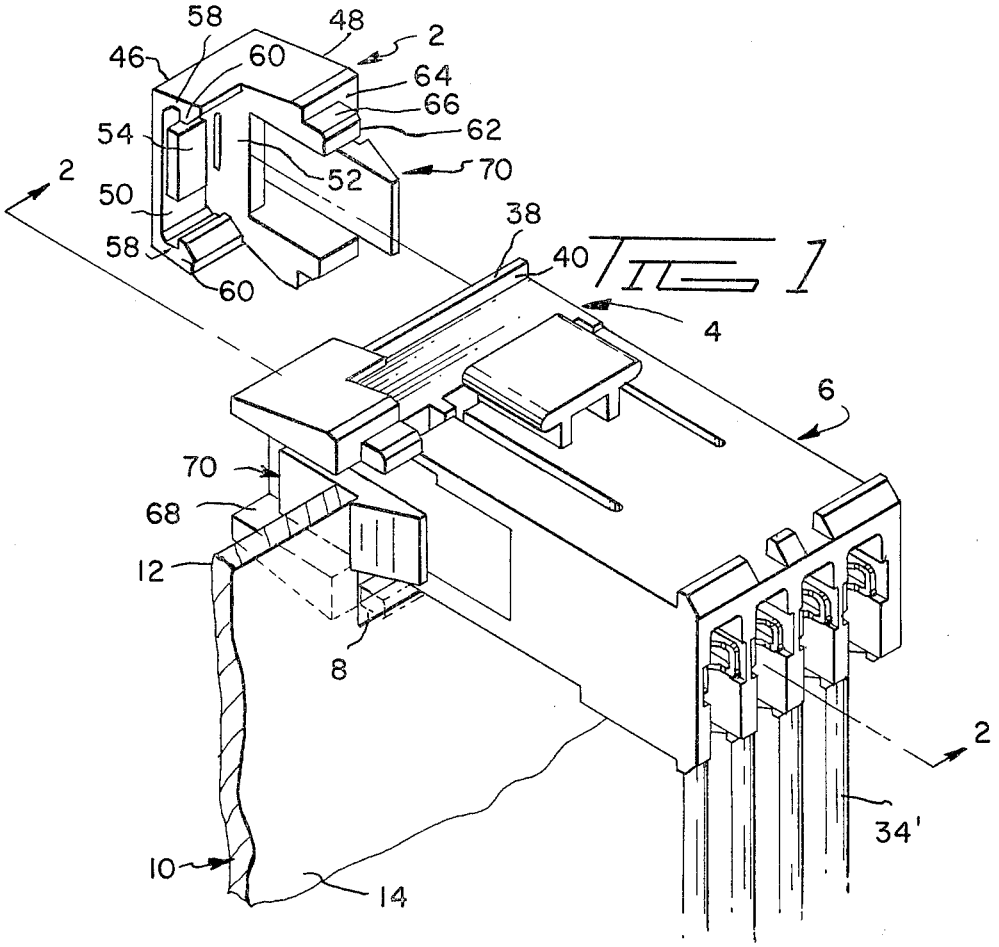
FIG. 1 is a perspective view showing a connector assembly mounted in a panel opening with one of the latching devices exploded from one of the connector parts.
Figure 2:
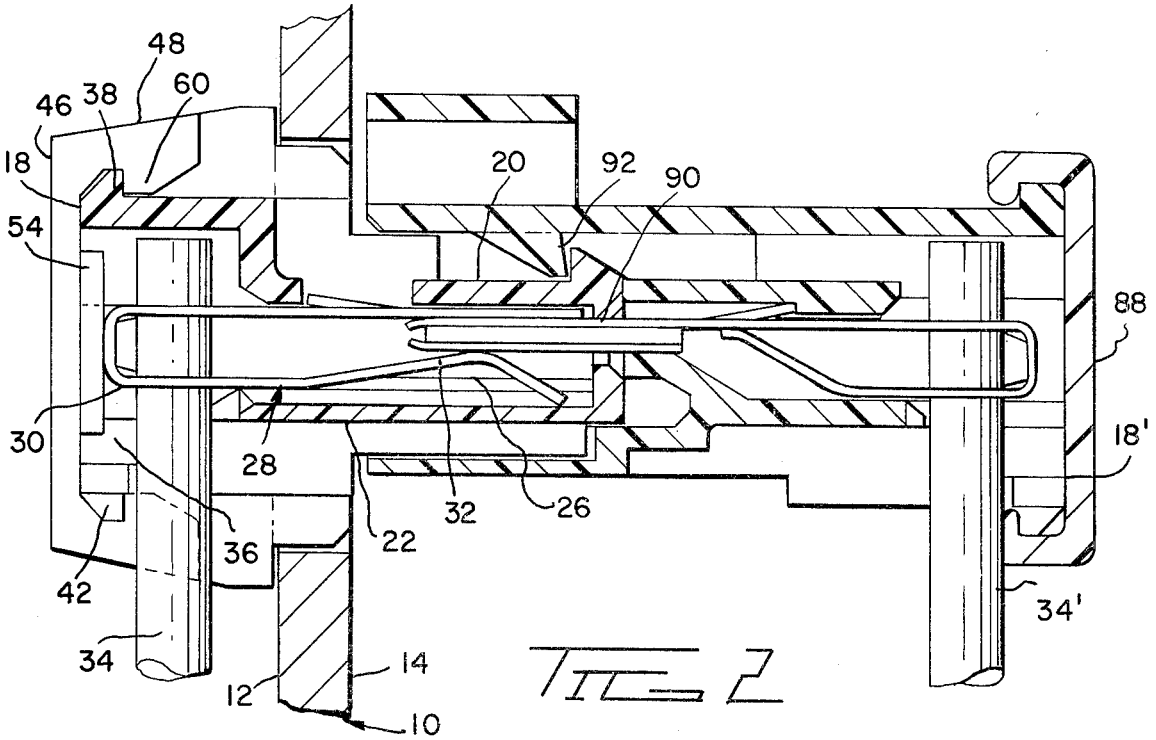
FIG. 2 is a cross-sectional view taken along the lines 2—2 of FIG. 1.
Figure 3:
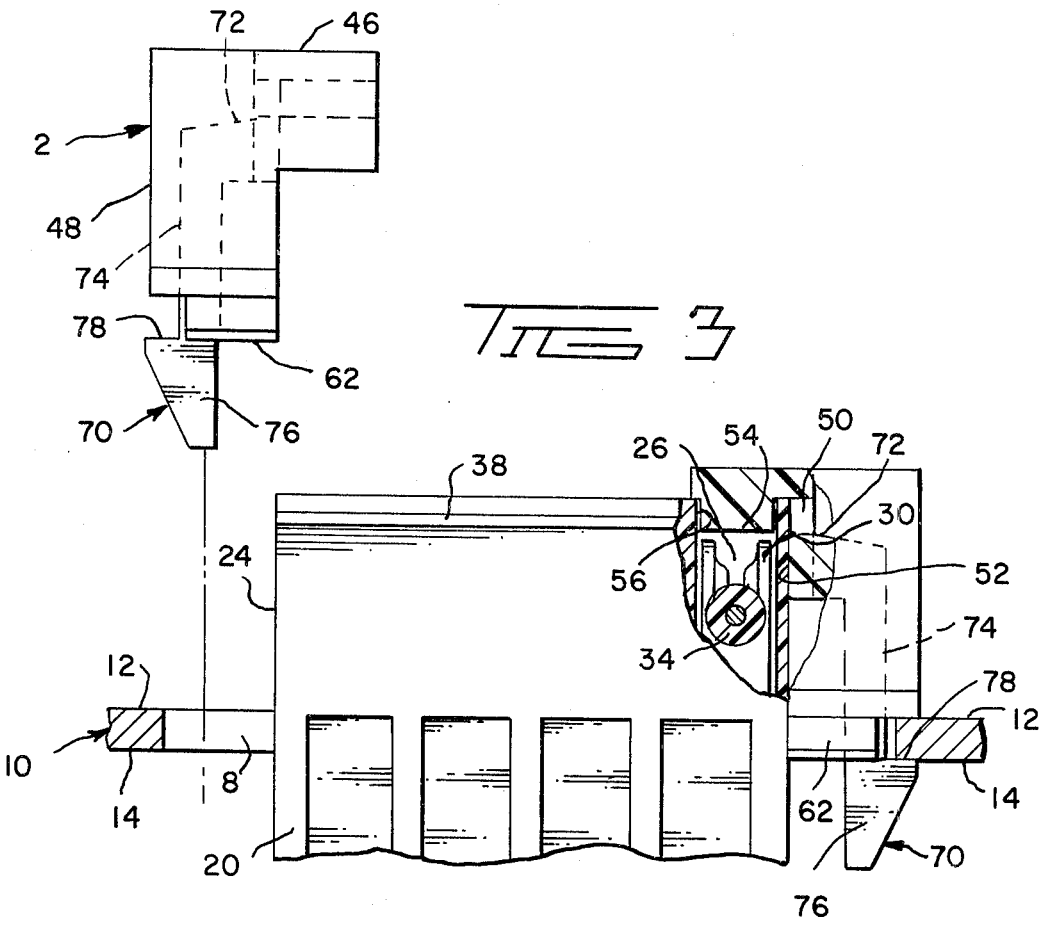
FIG. 3 is a fragmentary plan view of the connector part shown in FIG. 1 which has the latching devices thereon and which is mounted in the panel, one of the latching devices being exploded from the connector housing.
Figure 4:
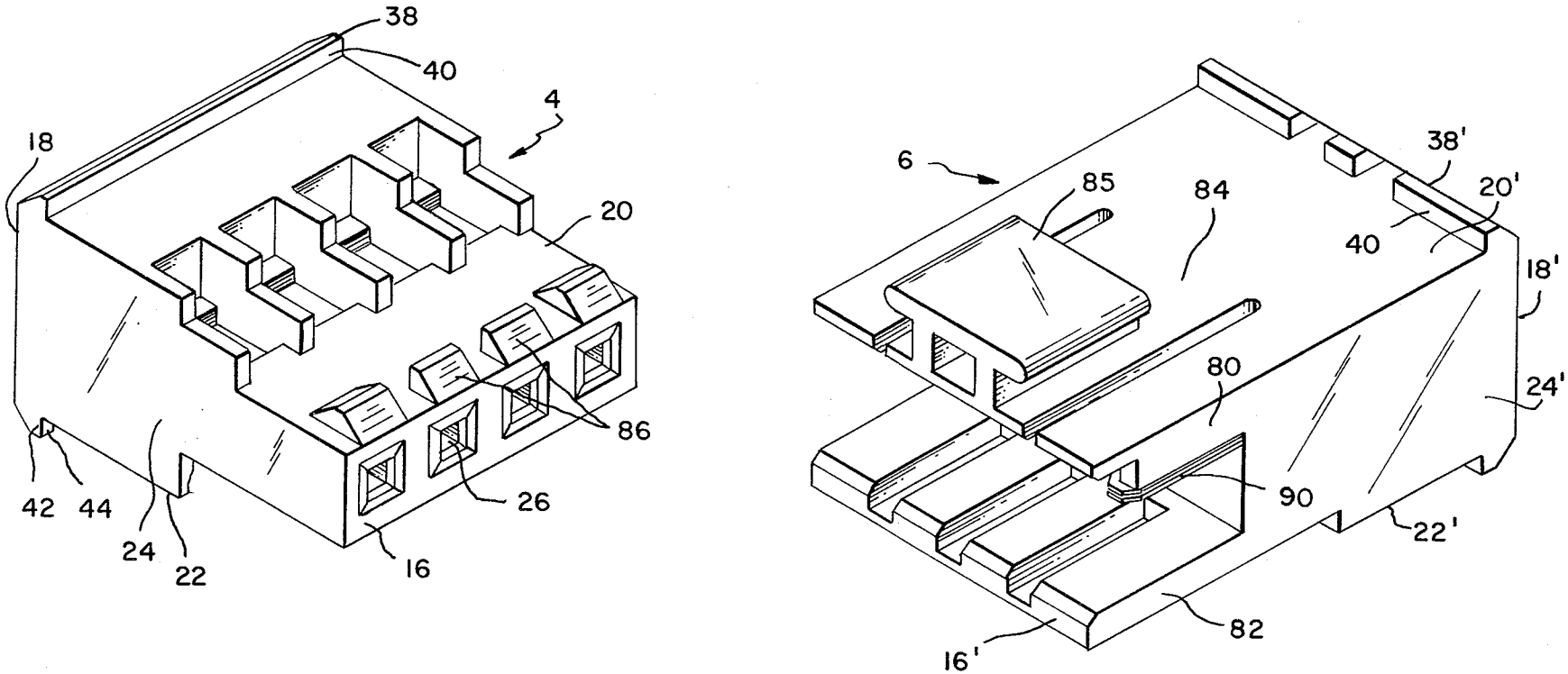
FIG. 4 is a perspective view showing the two connector housings of the connector assembly.

A latching device 2 in accordance with the invention is intended for assembly to either a connector plug 4 or a connector receptacle 6 and serves to mount the housing to which it is assembled in an opening 8 of a panel 10. In FIGS. 1–3, the latching devices are associated with the plug housing 4 and this housing extends through an opening 8 in the panel 10 from the side 12 of the panel and beyond the side 14. The receptacle housing 6 can thus be coupled to or uncoupled from the plug housing 4 from the side 14 of the panel.

The structure of the plug housing 4 is briefly described below to the extent ncessary for an understanding of the present invention. It will be understood that a latching device 2 can be used with other types of connector housings, such as the receptacle housing 6, and can be used with housings having greater or lesser numbers of terminals therein than the housings shown.

The plug housing 4 is of molded thermoplastic material and has a mating end 16, a rearward end 18, upper and lower sidewalls (as viewed in the drawing) 20,22, and endwalls 24 which extend between the ends 16, 18. A plurality of contact-receiving cavities 26 extend through the housing from the rearward end to the mating end 16, adjacent cavities being separated from each other by barrier walls as shown in FIG. 3. The terminals 28 in the embodiment shown are of the type fully described in application Ser. No. 879,575, now U.S. Pat. No. 4,168,874 and comprise wire-receiving portions 30 adjacent to the mating end of the housing and which receive complementary terminal pins 90 as shown in FIG. 2.

Wires 34 are electrically connected to the ends 30 of the terminals by means of wire-receiving slots in the terminals, the edges of these slots being dimensioned to penetrate the insulation of the wires and establish electrical contact with the conducting cores. The external sidewall 22 has wire-admitting slots 36 therein extending inwardly from the rearward end 18 and the wires extend laterally through these wire-admitting slots 36 as shown in FIG. 2.

A flange 38 extends transversely across the sidewall 20 adjacent to the rearward end 18 and this flange has a forwardly facing shoulder 40 which is cooperable with attaching means on the latching device 2 for securing the latching device to the housing as will be described below. Spaced-apart flanges 42 are provided on the lower external sidewall 22, these flanges being between the wire-admitting slots 36 and providing similar forwardly facing shoulders 44.

The latching device 2 is generally L-shaped as shown, having first and second arms 46, 48, these arms having first and second internal surfaces 50, 52 which intersect to form a pocket which is dimensioned to receive a rearward corner of the housing. The first arm has attaching means thereon for attaching the member 2 to the housing, this attaching means comprising flanges 58 on each side of the surface 50 and inwardly directed lips 60 on the ends of these flanges. The flanges 58 are dimensioned such that they will extend over the flanges 38 and 42 as shown in FIG. 2, when a device is assembled to the housing with the shoulder surfaces 40, 44 against the lips 60. The attaching means additionally comprises a rectangular boss 54 which extends centrally from the surface 50 and which is dimensioned to be received in the terminal-receiving cavity 26 in the housing which is adjacent to the endwalls, as shown in FIG. 3, so that the sides of the bosses are against internal wall surfaces of the cavities as shown at 56.

The housing 4 is stabilized in the opening 8 by means of bearing surfaces 64, 66 on the outer or free ends 62 of the second arms 48 of the latching devices. These free ends are dimensioned to fit into the opening 8 so that the surfaces 64 bear against the surface 12 of the panel and the surfaces 66 bear against the surfaces of the opening 8, as best shown in FIG. 2. A recess 68 is provided in the external surface of the second arm 48 and extends from the corner of the latching device towards the free end of the arm 48. A latch arm 70 extends from the floor of this recess as shown at 72 and has a flexible portion 74 which extends in the recess beyond the free end of the arm 48. The latch arm 70 has an enlarged end 76 which is tapered, as shown, to its free end and provides a rearwardly facing shoulder 78 for engagement with portions of the surface 14 of the panel adjacent to the opening 8.

In use, and if it is desired to mount the housing 4 in the panel, it is merely necessary to snap a latching device 2 onto each of the rearward corners of the housing by moving the latching devices from their exploded positions of FIGS. 1 and 3 to their assembled positions. As the latching devices are moved towards the housing, the flanges 58 are cammed outwardly until the ends of these flanges snap over the flanges 38 and 42 of the housing. The bosses 54 will then be snugly received in the cavities 26 which are adjacent to the endwalls 24 as described previously. The housing 4 is then mounted in the panel by moving it through the opening 8, mating end first, from the side 12 until the latch arms engage the side 14 of the panel. The connector housing 6 can then be engaged with and disengaged from the housing 4 from the side 14 of the panel.

If desired, a channel-shaped cover as shown at 88, FIG. 2, can be secured to the rearward face of the housing 4 between the latching devices so that all of the cavities in the housing will be covered at their rearward ends. FIG. 2 shows a cover 88 assembled to the rearward face 18' of the receptacle housing 6 which is described briefly below.

The receptacle housing has a rearward end 18', external sidewalls 20', 22' and external endwalls 24' which conform dimensionally or have the same dimensions at the rearward end as the dimensions of the housing 4. The mating end 16' has a recess which receives the mating end of the plug housing and latching means are provided on the upper flange 80 of the housing. This latching means comprises a flexible central section 84 of the housing which has shoulder means 92 on its underside for engagement with rearwardly facing shoulders of bosses 86 on the sidewall 20 of the housing 4. An integral finger piece 85 is provided on the latch arm to permit lifting thereof. The terminals in the receptacle housing are pin terminals as shown at 90, and are dimensioned to be received by the terminals 28 in the housing 4.

It will be apparent that a plug 4 or a receptacle 6 can be mounted in a panel in accordance with the invention. Latching devices 2 can be mounted on either of the housings to secure either housing in a panel opening 8. Furthermore, a standard size rectangular opening 8 in the panel 14 can be used for either of the connector parts 4, 6, having latching devices 2 on their corners. As is apparent from FIG. 2, when the plug member 4 is mounted in the opening 8, the upper edge of the opening is against the upper surfaces 66 of the latching members and the lower horizontal edge of the opening is against the lower surfaces 66. It will be apparent from FIG. 2 that the standard opening 8 required for the plug member is sufficiently large to permit passage of the forward end of the receptacle member therethrough.

We claim:

1. A molded thermoplastic latching device which, along with a similar latching device, is intended for assembly to a connector housing to provide latching means on said housing to latch said housing to a panel when said housing is inserted into an opening in said panel, said housing having a mating face, a rearward face, external sidewalls and internal endwalls between said faces, said latching device comprising:

an L-shaped member having first and second arms, said first and second arms having first and second internal surfaces and first and second external surfaces respectively, said internal surfaces intersecting to form a pocket which is dimensioned to receive a rearward corner of said housing with said rearward face against said first internal surface and with one of said endwalls against said second internal surface, attaching means on said first arm for attaching said L-shaped member to said housing at said rearward corner, said second arm having a free end and having bearing surface portions on said free end for bearing against one side of said panel and against portions of said opening in said panel, and latch arm means for engagement with said panel, said latch means comprising a flexible latch arm which extends parallel to said second arm, said latch arm being spaced from said second internal surface and being flexible towards said second internal surface, said latch arm having a free end and having rearwardly facing shoulder means on said free end for bearing against the other side of said panel whereby, upon assembling one of said latching devices to each of the rearward corners of said housing and inserting said housing into opening in said panel until said bearing surface portions are against said one side of said panel and against said opening, said latch arms will be flexed towards said second internal surfaces until said shoulders are through said openings, and said shoulders will then bear against the other side of said panel.

2. A molded thermoplastic latching device as set forth in claim 1, said latching device being symmetrical with respect to a plane extending normally and medially through said first and second arms whereby identical latching members can be assembled to said rearward corners of said housing.

3. A molded thermoplastic latching device as set forth in either of claims 1 or 2, said attaching means on said first arm comprising flanges extending from said first arm on each side of said first internal surface and normally of said second internal surface, said flanges having interengageable means thereon which are engageable with complementary interengageable means on said housing.

4. A molded thermoplastic latching device as set forth in claim 3, said interengageable means on said flanges comprising shoulders on said flanges which extend parallel to, and are opposed to, said first internal surface.

5. A molded thermoplastic latching device as set forth in claim 4, said housing having terminal-receiving cavities extending therethrough from said rearward face to said mating face, said first internal surface covering one of said cavities at said rearward face when said device is assembled to said housing, said first internal surface having a centrally located boss thereon which is dimensioned to be snugly received in said one cavity thereby to stabilize said device on said housing.

6. A molded thermoplastic latching member as set forth in claim 1, said second arm having a recess in said external surface thereof, said recess intersecting said first external surface and extending towards said free end of said second arm, said latch arm being integral with said device in said recess and extending from said recess.

7. A molded thermoplastic latching member as set forth in claim 1, said second arm having a reduced cross-section at said free end, said bearing surface portions comprising shoulder surfaces provided by said reduced cross section.

* * * * *